US008902267B2

(12) United States Patent
Oda

(10) Patent No.: US 8,902,267 B2
(45) Date of Patent: Dec. 2, 2014

(54) DRAWING CONTROL METHOD, LASER IRRADIATING APPARATUS, DRAWING CONTROL PROGRAM, AND RECORDING MEDIUM HAVING RECORDED THEREWITH

(75) Inventor: Miyuki Oda, Shizuoka (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 13/502,249

(22) PCT Filed: Oct. 14, 2010

(86) PCT No.: PCT/JP2010/068536

§ 371 (c)(1),
(2), (4) Date: Apr. 16, 2012

(87) PCT Pub. No.: WO2011/049148

PCT Pub. Date: Apr. 28, 2011

(65) Prior Publication Data

US 2012/0200656 A1 Aug. 9, 2012

(30) Foreign Application Priority Data

Oct. 19, 2009 (JP) ..... 2009-240398
Sep. 10, 2010 (JP) ..... 2010-202723

(51) Int. Cl.

| | |
|---|---|
| ***B41J 2/47*** | (2006.01) |
| ***B41J 2/435*** | (2006.01) |
| ***B41J 2/00*** | (2006.01) |
| ***B41J 2/475*** | (2006.01) |

(52) U.S. Cl.
CPC ..... *B41J 2/4753* (2013.01)
USPC ..... 347/252; 347/262; 347/110

(58) Field of Classification Search
USPC ..... 347/252, 262, 110
See application file for complete search history.

(56) References Cited

U.S. PATENT DOCUMENTS

| | | | | |
|---|---|---|---|---|
| 4,928,277 | A | 5/1990 | Monma et al. | |
| 2007/0038464 | A1 * | 2/2007 | Sato et al. | 705/1 |
| 2008/0214391 | A1 * | 9/2008 | Kawahara et al. | 503/201 |
| 2011/0235134 | A1 | 9/2011 | Hasegawa et al. | |

FOREIGN PATENT DOCUMENTS

| | | |
|---|---|---|
| JP | 63 315246 | 12/1988 |
| JP | 2002 178173 | 6/2002 |
| JP | 3501987 | 3/2004 |
| JP | 2006-255718 A | 9/2006 |
| JP | 2010 156950 | 7/2010 |

OTHER PUBLICATIONS

International Search Report issued on Jan. 18, 2011 in PCT/JP10/068536 filed on Oct. 14, 2010.
Office Action issued on Jul. 15, 2014 in the corresponding Japanese Patent Application No. 2010-202723.

* cited by examiner

*Primary Examiner* — Justin Seo
*Assistant Examiner* — Kendrick Liu
(74) *Attorney, Agent, or Firm* — Oblon, Spivak, McClelland, Maier & Neustadt, L.L.P.

(57) ABSTRACT

Drawing control methods, laser irradiating apparatuses, drawing control programs, and recording mediums having recorded therewith are provided that make it possible to efficiently carry out drawing with high quality. The drawing control method controls, by a computer, a drawing device which draws what is to be drawn onto multiple unit regions on a surface of a medium. The computer executes a drawing order determining step which determines a drawing order of a line segment included in the what is to be drawn such that multiple continuing line segments over mutually neighboring multiple unit regions are drawn continuously.

14 Claims, 16 Drawing Sheets

| CODE | ID |
|---|---|
| A1 | id001 |
| A2 | id002 |
| A3 | id003 |
| . . . | . . . |

FIG.8A

| CODE | x COORDINATE | y COORDINATE | SIZE |
|---|---|---|---|
| A1 | x1 | y1 | s12 |
| A2 | x1 | y2 | s12 |
| A3 | x1 | y3 | s12 |
| . . . | . . . | . . . | . . . |

FIG.8B

DRAWING CONTROL METHOD, LASER IRRADIATING APPARATUS, DRAWING CONTROL PROGRAM, AND RECORDING MEDIUM HAVING RECORDED THEREWITH

TECHNICAL FIELD

The present invention relates to drawing control methods, laser irradiating apparatuses, drawing control programs, and recording media having recorded therewith.

BACKGROUND ART

Thus far, forming and erasing of images on and from a heat reversible recording medium (a medium) are carried out using a contact-type method such that a heat source is made to be in contact with the medium to heat the medium. Normally, as the heat source, a thermal head is used for image forming, while a heat roller, a ceramic heater, etc., are used for image erasing.

Such a contact-type recording method is advantageous in that, when the heat reversible recording medium is a flexible one such as a film, paper, etc., it is possible to carry out uniform image forming and erasing by uniformly pushing the medium against the heat source using a platen, etc., and it is possible to inexpensively manufacture an image forming device and an image erasing device by diverting a component for a printer for a conventional thermal paper for use therein.

However, with a contact-type recording method, there are problems of decreased density and defective erasing since, when printing and erasing are repeated, a medium surface becomes shaven, and unevenness is produced, causing a part thereof not to be in contact with the heat source such as a thermal head, a hot stamp, etc., and causing non-uniform heating.

Thus, as a method of image forming and erasing uniformly in a non-contact manner, a method of using a laser is being proposed, for example. In this method, which uses the heat reversible recording medium for a transport container used for a distribution line, writing is carried out with the laser, while erasing is carried out with hot air, warm water, an infrared heater, etc. A non-contact type recording method makes it possible to carry out recording even when unevenness is produced on the surface of the heat reversible recording medium.

As an example of such a device which carries out recording in a non-contact manner using the laser, a laser irradiating device (a laser marker or a laser marking device) is commercially available which utilizes a technique such that a laser beam is irradiated onto a medium such as metal, plastic, thermal paper, etc., to heat the medium to write thereto a letter, a number, a symbol, etc.

The laser beam may be irradiated using a gas laser, a solid-state laser, a liquid laser, a semiconductor laser, etc., as a laser beam source of the laser irradiating device to write a letter, etc., onto a medium such as metal, plastic, thermal paper, etc.

Drawing is carried out by irradiating the laser beam for heating to shave and burn the metal and the plastic. In the meantime, for the thermal paper, which has a property to change color due to heat, drawing is carried out by a recording layer developing color through heating with laser beam irradiating.

Compared with a metal or plastic medium, the thermal paper is easy to handle, so that it is widely used in a field of distribution, etc., as a medium onto which an article name or an intended address of an article is printed.

Moreover, when the heat reversible recording medium within the medium is used, the laser beam is irradiated onto the heat reversible recording medium, so that a photothermal conversion material absorbs the beam to convert the absorbed beam to heat, with which it is possible to carry out recording and erasing. As a related-art technique of image forming and erasing using the laser, a laser recording method is being used which carries out recording using a near-infrared laser beam, combining leuco dyes, a reversible developer, and various photothermal conversion materials.

Then, a technique is known which prints a two-dimensional code onto a medium using such a laser recording method.

Moreover, as shown in FIG. 1A, to draw a two-dimensional code which includes six two-dimensional code components (below, components, which are elements included in two-dimensional code components that are divided for each cell, are called two-dimensional code components), there is a method which carries out drawing by a raster scan as shown in FIG. 1C. In this method of drawing, line segments for drawing the two-dimensional code are drawn line by line. When each two-dimensional code component included in the two-dimensional code is formed by two line segments, for drawing the two-dimensional code in FIG. 1A, it is necessary to draw over four lines, so that line segments (a line segment denoted with a drawing order 1 and a line segment denoted with a drawing order 2) on a first line are drawn and then line segments (a line segment denoted with a drawing order 3 and a line segment denoted with a drawing order 4) on a second line are drawn. Then, line segments (a line segment denoted with a drawing order 5 and a line segment denoted with a drawing order 6) on a third line and line segments (a line segment denoted with a drawing order 7 and a line segment denoted with a drawing order 8) on a fourth line are to be drawn. Such a raster scan may be carried out to draw line segments of joined two-dimensional code components, with a shorter total distance for moving from a line segment drawn to the subsequent line segment, making it possible to carry out drawing in a short time (see Patent document 1, for example).

However, with related-art laser recording methods, when a two-dimensional code is drawn, there are problems that it takes a long time for printing and printing quality is poor. Moreover, these problems occur, not only with a heat reversible recording medium, but also with processing metal, plastic, etc., with a laser.

More specifically, there is a method of drawing six two-dimensional code components in drawing orders 1-12 as shown in FIG. 1B, for example. With this method, for the six two-dimensional code components included in the two-dimensional code shown in FIG. 1A, drawing of one of the two-dimensional code components is completed before moving on to draw the subsequent two-dimensional code component.

However, as the two-dimensional code components shown in FIG. 1B are drawn with two line segments, in general, it is often a case that one of the two-dimensional code components is formed of line segments on multiple lines, so that, with the drawing method shown in FIG. 1B, there is a problem that it takes time for moving to the subsequent two-dimensional code component each time, leading to a long time required for drawing in total.

Moreover, there is a problem that it is more difficult for a color to develop at a start point of each line segment that has little heat stored relative to the other parts. To draw the two-dimensional code components as shown in FIG. 2A, a gap opens with a neighboring two-dimensional code component in a line direction (shown as a horizontal direction) as shown in FIG. 2B when drawing is carried out using the drawing method in FIG. 1B unless the starting point develops color. In order for the starting point to develop color, it is necessary to irradiate a laser with a stronger drawing output. However, there is a problem that increasing the laser output for just the starting point causes a large amount of energy to be applied to the medium, leading to color development decreasing, some non-erased parts remaining, etc., and, thus, a repeated degradation in durability.

Moreover, with the method in FIG. 1C, a longer line segment for drawing joined two-dimensional components in the line direction has a larger amount of heat stored relative to a shorter line segment, causing high printing density. In other words, in order to draw the two-dimensional code components as in FIG. 3A, there is a problem, as shown in FIG. 3B, that joined two-dimensional code components end up getting printed denser relative to a separate two-dimensional code component.

Moreover, even with the method of FIG. 1C, as with the drawing method of FIG. 1B, the line segment ends up being shorter by an amount corresponding to how weak the color development is at the starting point. Then, as an impact of a phenomenon of the line segment becoming shorter is greater for a separate or shorter two-dimensional code component relative to the joined two-dimensional code components, there is a problem that, as shown in FIG. 2C, the separate or shorter two-dimensional code component ends up getting larger relative to the joined two-dimensional code components. (In other words, the separate or shorter two-dimensional code component ends up getting printed smaller relative to the joined two-dimensional code components.

Furthermore, when the length of one line of the two-dimensional code is small, or the drawing speed is fast, there may be cases where the impact of heat when drawing the previous line remains when the subsequent line is drawn. In this case, when the subsequent line is drawn, as shown in FIG. 4, a part which should not develop color in the first place that is other than the six two-dimensional code components ends up developing color, causing printing quality to become poor. In this way, a part which should not develop color in the first place ending up developing color is a problem which may occur in either one drawing method of FIG. 1B and FIG. 1C.

Patent Document

Patent document 1: JP3501987A

SUMMARY OF THE INVENTION

Means for Solving the Problems

Thus, the object of the present invention is to provide drawing control methods, laser irradiating apparatuses, drawing control programs, and recording media having recorded therewith that make it possible to efficiently carry out drawing with high quality.

According to one aspect of an embodiment of the present invention, a drawing control method is provided which controls, by a computer, a drawing device which draws what is to be drawn onto multiple unit regions on a surface of a medium, wherein the computer executes a drawing order determining step which determines a drawing order of a line segment included in the what is to be drawn such that multiple continuing line segments over mutually neighboring multiple unit regions are drawn continuously.

According to another aspect of the embodiment of the present invention, a drawing control method is provided which controls, by a computer, a drawing device which draws what is to be drawn onto multiple unit regions on a surface of a medium, wherein the computer executes a drawing location determining step which moves backward by a predetermined distance in a drawing direction a drawing starting location of one or multiple continuing line segments when determining a drawing location at which is drawn a line segment including the what is to be drawn onto the medium based on drawing information for drawing the what is to be drawn.

According to a further aspect of the embodiment of the present invention, a drawing control method is provided which controls, by a computer, a drawing device which draws what is to be drawn onto multiple unit regions on a surface of a medium, wherein the computer executes a drawing output setting step which divides, into multiple drawing intervals, one or more continuing line segments included in the what is to be drawn, and sets, in a pulse shape, a drawing output for the drawing device to draw the what is to be drawn for each of one or more continuing drawing intervals of the multiple drawing intervals.

According to a yet further aspect of the embodiment of the present invention, a drawing control method is provided which controls, by a computer, a drawing device which draws what is to be drawn onto multiple unit regions on a surface of a medium, wherein the what is to be drawn includes multiple line segments and the line segments are arranged over multiple lines, wherein the computer executes a drawing order determining step which, when determining a drawing order of the multiple line segments included in the what is to be drawn, determines a drawing order of the line segments such that a line segment on an odd-numbered line is successively drawn line by line and then a line segment on an even-numbered line is successively drawn line by line, or a line segment on the even-numbered line is successively drawn line by line and then a line segment on the odd-numbered line is successively drawn line by line.

According to one aspect of an embodiment of the present invention, a laser irradiating apparatus is provided which is controlled by any one of the above drawing control methods, including:

a laser oscillator which irradiates a laser;

a direction control mirror which controls an irradiating direction of a laser which is irradiated by the laser oscillator; and a direction control motor which drives the direction control mirror.

According to one aspect of an embodiment of the present invention, a drawing control program is provided for executing any one of the above drawing control methods.

According to one aspect of an embodiment of the present invention, a recording medium is provided having recorded thereon the above-described drawing control program.

The above-described drawing control methods, laser irradiating apparatuses, drawing control programs, and recording media having recordings make it possible to efficiently carry out drawing with high quality.

BRIEF DESCRIPTION OF THE DRAWINGS

FIG. 8A is a drawing illustrating an example of a two-dimensional code DB 41;

FIG. 8B is a drawing illustrating an example of a drawing condition DB 43;

DESCRIPTION OF THE REFERENCE NUMERALS

Figure 1A:
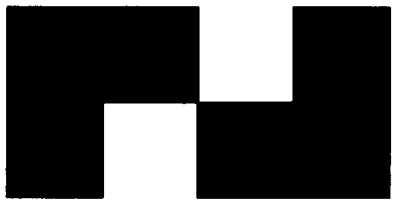
FIGS. 1A through 1C are views for explaining related-art drawing methods.

10 drawing device
11 laser oscillator
12 direction control motor
13 direction control mirror
14 optical lens
15 condenser lens
20 drawing control device
21 drawing location determining unit
22 drawing order determining unit
23 drawing instruction generating unit
24 two-dimensional code obtaining unit
25 drawing condition obtaining unit
31 CPU
32 memory
33 CD-ROM drive
34 network device
35 hard disk
36 input device
37 display
38 CD-ROM (recording medium)
41 two-dimensional code DB
42 drawing program
43 drawing condition DB
50 rewritable medium
100 laser marking device

MODE FOR CARRYING OUT THE INVENTION

Below, embodiments are described to which a drawing control method, a laser irradiating device, a drawing control program, and a recording medium having recorded therewith of the present invention are applied.

Here, the term "what is to be drawn" is used to represent a two-dimensional code or a component thereof that is to be drawn.

Moreover, a "line segment" is an interval which is included in the two-dimensional code or the component thereof that is to be drawn and for which coordinates of both ends thereof are predetermined in order to the draw what is to be drawn. This segment includes not only a part of a straight line, but also a part of a curve, and has a thickness.

Moreover, "a one-stroke component" is used to include one or more line segments that are drawn continuously from a location at which drawing is started to a location at which drawing is finished. For example, when drawing is carried out with laser irradiation, one stroke which is drawn from a starting point to an end point of irradiating a laser once becomes the one-stroke component.

Thus, the two-dimensional code or the component thereof that is to be drawn includes one or more one-stroke components, while the one-stroke component has one or more line segments.

Moreover, the term "drawing order" is used such that it has two meanings: an order of drawing line segments included in what is to be drawn (including an order of drawing a line segment, i.e., from which end); and an order of drawing multiple ones to be drawn that are included in the two-dimensional code.

Embodiment 1

Figure 5:
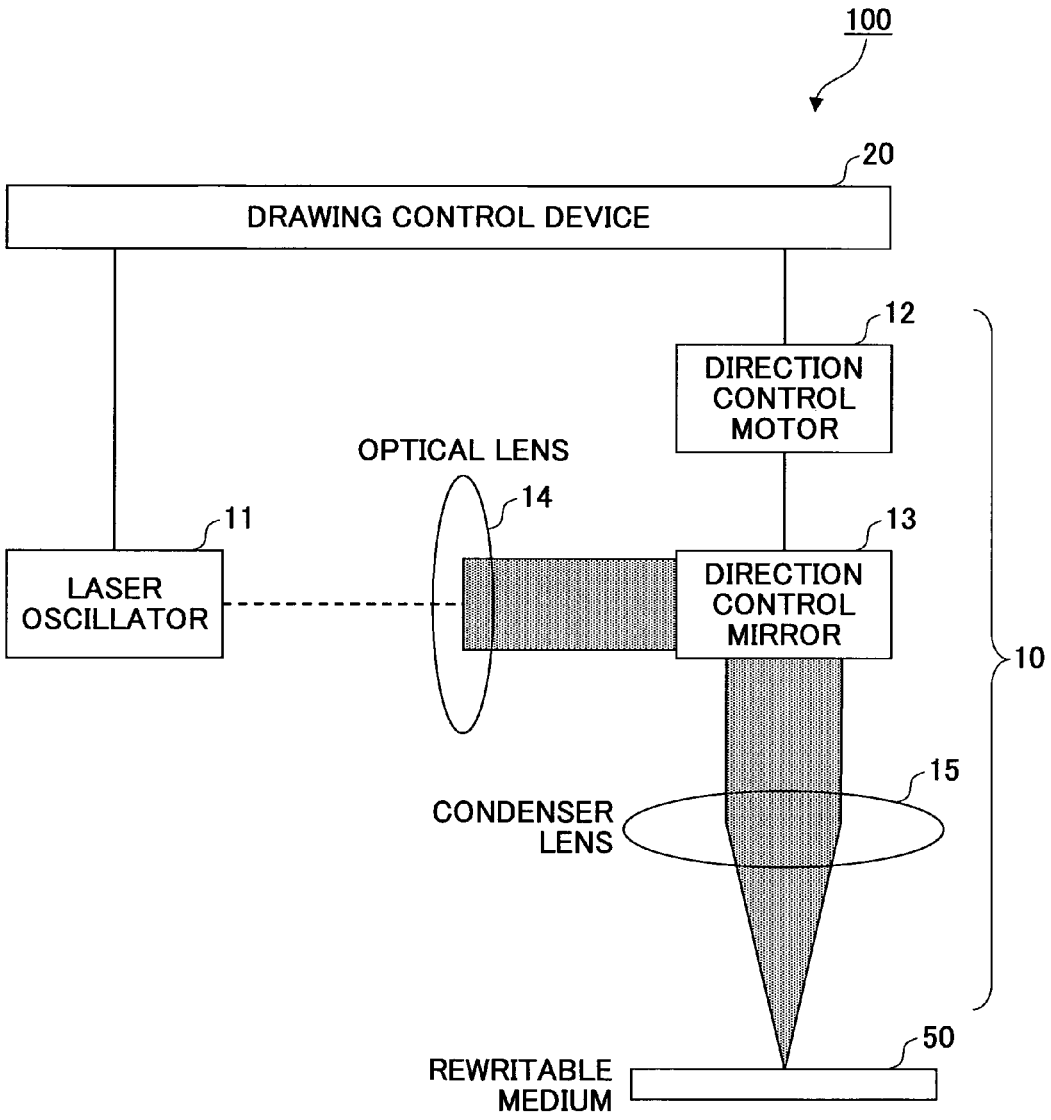
FIG. 5 is a drawing illustrating one example of a hardware configuration of a laser marking device 100 according to an embodiment 1.

FIG. 5 is a drawing illustrating one example of a hardware configuration of a laser marking device 100 according to an embodiment 1.

The laser marking device 100 has a drawing device 10 which irradiates a laser and a drawing control device 20 which controls drawing of the drawing device 10. The drawing device 10 includes a laser oscillator 11 which irradiates a laser, a direction control mirror 13 which changes a direction of laser irradiation, a direction control motor 12 which drives the direction control mirror 13, an optical lens 14, and a condenser lens 15.

The laser oscillator 11, which is a semiconductor laser (LD (laser diode)), may also be a gas laser, solid-state laser, a liquid laser, etc. The direction control motor 12 is, for example, a servo motor which controls a direction of a reflection plane of the direction control mirror 13 according to two axes. The direction control motor 12 and the direction control mirror 13 make up a galvanometer mirror. The optical lens 14 is a lens which increases a spot diameter of a laser beam, while the condenser lens 15 is a lens which condenses the laser beam.

A rewritable medium 50 is a rewritable thermal medium which develops color by undergoing heating to a temperature of at least 180 degrees Celsius and quenching, and achromatizes by undergoing heating to a temperature of 130-170 degrees Celsius. As normal thermal paper or thermal rewritable medium does not absorb a laser beam in a near-infrared region, when using a laser beam source (YAG such as a solid-state laser, a semiconductor laser, etc.) which oscillates at a near-infrared laser wavelength, it is necessary to add a layer or add a laser-beam absorbing material to the thermal paper or the thermal rewritable medium. Rewriting means heating with a laser beam to carry out recording, and heating with a laser beam, hot air, a hot stamp, etc., to carry out erasing. Moreover, non-rewritable thermal paper means thermal paper which is difficult to achromatize by heating. The present embodiment, which is described with a case of using a rewritable medium 50 as an example of a medium used, may also be suitably applied to non-rewritable media such as thermal paper, plastic, metal, etc., that are not rewritable.

Figure 6:
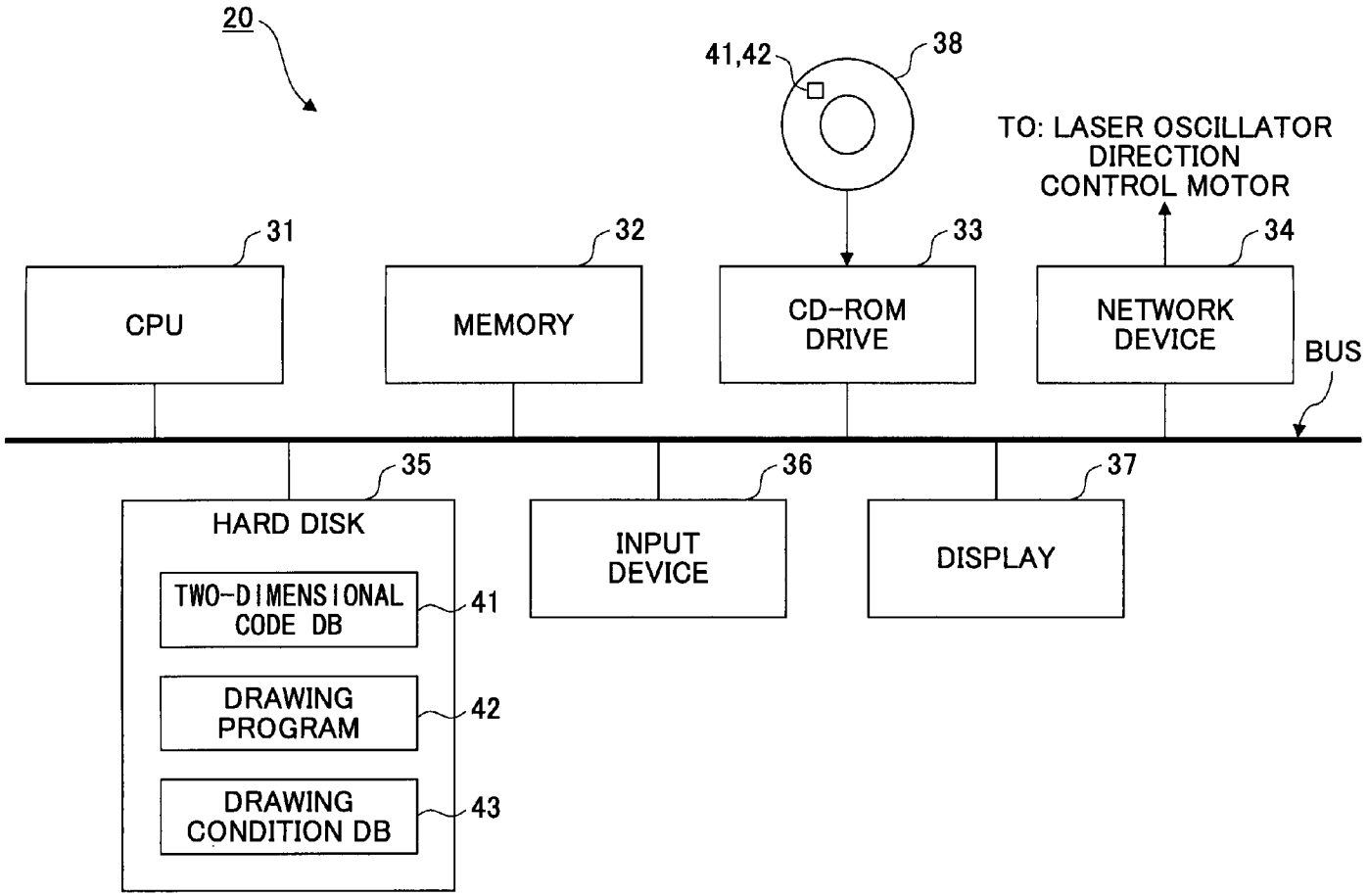
FIG. 6 is a diagram illustrating an example of a hardware configuration of a drawing control device 20.

FIG. 6 is a diagram illustrating an example of a hardware configuration of a drawing control device 20. FIG. 6, which is a hardware configuration diagram when the drawing control device 20 is implemented primarily by software, shows a computer as an entity. When implementing the drawing control device 20 with a computer not as an entity, an IC is used which is produced for a special function such as an ASIC (application specific integrated circuit).

The drawing control device 20 has a CPU 31, a memory 32, a hard disk 35, an input device 36, a CD-ROM drive 33, a display 37, and a network device 34. On the hard disk 35 is stored a two-dimensional code DB 41 which stores data representing a two-dimensional code and components in the two-dimensional code, a drawing program 42 which generates drawing instructions for drawing the two-dimensional code and which controls the drawing device 10, and a drawing condition DB 43.

The CPU 31 reads out a drawing program 42 from the hard disk 35 to execute the read out drawing program, refers to the two-dimensional code DB 41, and draws the two-dimensional code onto the rewritable medium 50 according to a below-described procedure. The memory 32, which is a volatile memory such as a DRAM, etc., is to be an operating area for the CPU 31 to execute the drawing program 42.

The input device 36 is a device for a user to input an instruction which controls the drawing device 10 such as a mouse, a keyboard, etc. A drawing condition which represents a size, etc., of what is to be drawn such as a component included in a two-dimensional code to be drawn onto the rewritable medium 50 is input by a user via the input device 36, for example. The input drawing condition is stored in the hard disk 35, for example, as in the drawing condition DB 43. The drawing condition includes data representing size, etc., and a location of each of what is to be drawn as a component within the two-dimensional code. A data structure of the drawing condition will be described below using FIGS. 8A and 8B.

The display 37 is to be a user interface which displays a GUI (graphical user interface) screen with a predetermined resolution and color number based on screen information provided by the drawing program 42, for example. For example, a column for entering a component or a two-dimensional code to draw into the rewritable medium 50 is displayed.

The CD-ROM drive 33, which is arranged to removably contain a CD-ROM 38 therein, is utilized when reading data from the CD-ROM 38 and when writing data into a recordable recording medium. The two-dimensional code DB 41 and the drawing program 42, which are distributed in a form such that they are stored in the CD-ROM 38, are, read from the CD-ROM 38 to be installed in the hard disk 35. In lieu of the CD-ROM 38, other non-volatile memories may be used, such as a DVD, a Blue-ray disk, an SD card, a memory stick (registered trademark), a multimedia card, an xD card, etc.

The network device 34, which is an interface (e.g., an Ethernet (registered trademark) card) for connecting to a network such as the Internet, a LAN, etc., makes it possible to execute a process in accordance with a protocol specified for physical and data link layers of an OSI basic reference model to transmit, to the drawing device 10, a drawing instruction in accordance with a code which represents a type of two-dimensional codes. The two-dimensional code DB 41 and the drawing program 42 may be downloaded from a predetermined server connected via a network. The drawing control device 20 and the drawing device 10 may be connected directly via a USB (universal serial bus), an IEEE 1394, a wireless USB, a Bluetooth, etc.

The two-dimensional code, which is drawn onto the rewritable medium 50, is input from the input device 36 as described above, and is stored on the hard disk 35 as data in the form of a list, for example. A size of what is to be drawn that is included the two-dimensional code drawn into the rewritable medium 50 makes up a drawing condition.

The two-dimensional code is specified in a code which represents a type of the two-dimensional code and the drawing control device 20 reads two-dimensional code data corresponding to a type of the two-dimensional code from the two-dimensional code DB 41, and uses them for generating drawing instructions for controlling the drawing device 10.

Next, functional blocks of the drawing control device of the embodiment 1 are described with reference to FIG. 7.

Figure 7:
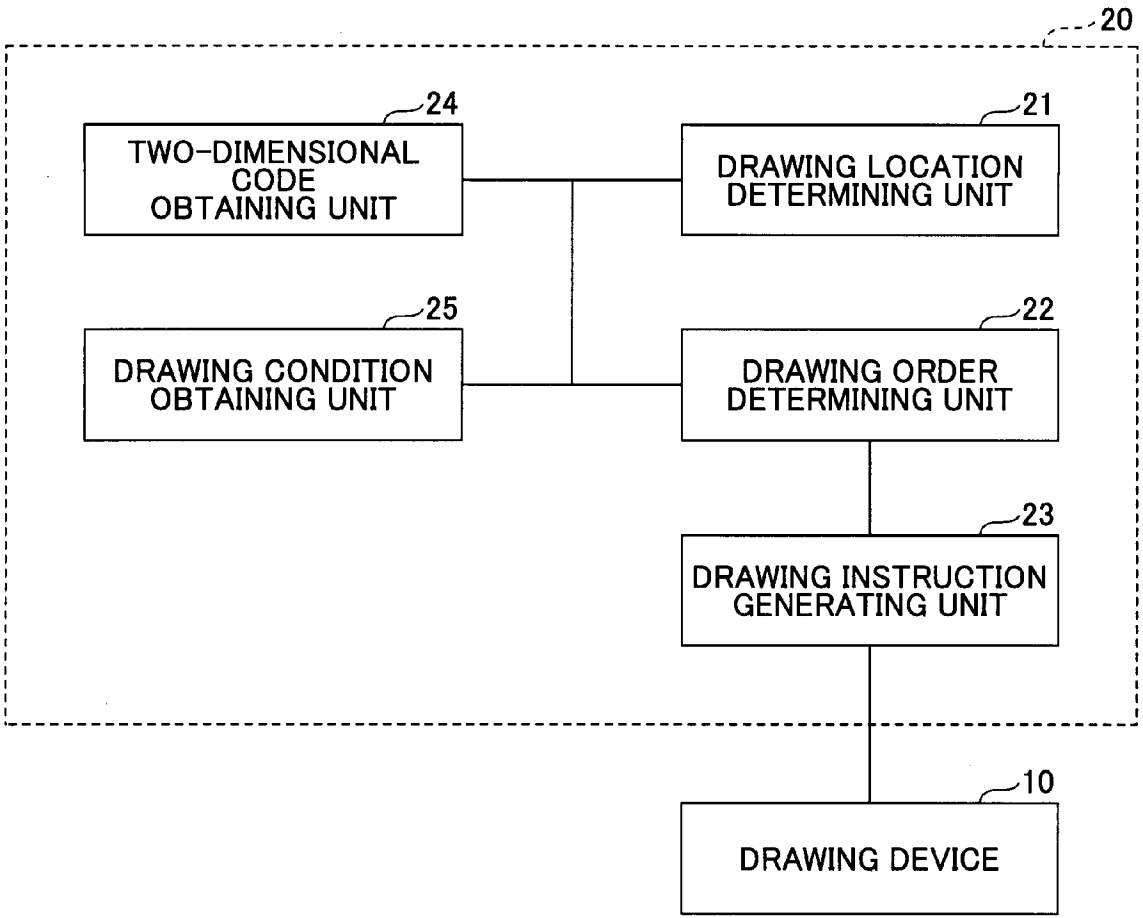
FIG. 7 is a drawing illustrating functional blocks of the drawing control device 20 of the embodiment 1.

FIG. 7 is a drawing illustrating functional blocks of the drawing control device 20 of the embodiment 1. Each block, when implemented in software, is implemented by the CPU 31 executing the drawing program 42.

The drawing control device 20 includes a drawing location determining unit 21, a drawing order determining unit 22, a drawing instruction generating unit 23, a two-dimensional code obtaining unit 24, and a drawing condition obtaining unit 25.

The drawing location determining unit 21 determines coordinate data, which is a drawing location for drawing, onto the rewritable medium 50, what is to be drawn, based on data representing the type of the two-dimensional code or the two-dimensional code component read from the two-dimensional code DB 41 by the two-dimensional code obtaining unit 24 and the drawing condition read out from the drawing condition DB 43 by the drawing condition obtaining unit 25. The drawing condition includes data representing a size, and a location of a component as each of what is to be drawn within the two-dimensional code. Data representing the drawing condition will be described below using FIGS. 8A and 8B.

The drawing instruction generating unit 23 generates a drawing instruction which reflects coordinate data determined by the drawing location determining unit 21 and a drawing order determined by the drawing order determining unit 22. The generated drawing instruction is input into the drawing device 10, and, as a result, what is to be drawn that represents a two-dimensional code or component input into the input device 36 by a user is drawn onto the rewritable medium 50 by the drawing device 10.

The drawing condition obtaining unit 25 obtains, from the drawing condition DB 43 which is stored in the hard disk 35, a drawing condition representing a condition of a size of a component as what is to be drawn that is included in a two-dimensional code, and the two-dimensional code which includes a component which is what is to be drawn that is drawn onto the rewritable medium 50.

FIG. 8A is a drawing illustrating an example of the two-dimensional code DB 41, and FIG. 8B is a drawing illustrating an example of the drawing condition DB 43.

As shown in FIG. 8A, the two dimensional code DB 41 contains a code for specifying a type of a two dimensional code or a two-dimensional code component, and an identifier which represents contents of data of the two-dimensional code or the two-dimensional code component which is specified by the code.

As shown in FIG. 8B, the drawing condition DB 43 includes data representing a size, and location data representing a location (x, y coordinates) at which each of what is to be drawn is arranged, and a code for specifying a type of a two-dimensional code or a two-dimensional code component to be drawn. The value of coordinates representing a location of what is to be drawn is, for example, a coordinate position on an upper left point in a region in which what is to be drawn is arranged.

While data included in FIGS. 8A and 8B are illustrated with a symbol which is a combination of an alphabet and a number, specific numerical values, etc., are provided in an actual drawing control device.

Figure 9A:
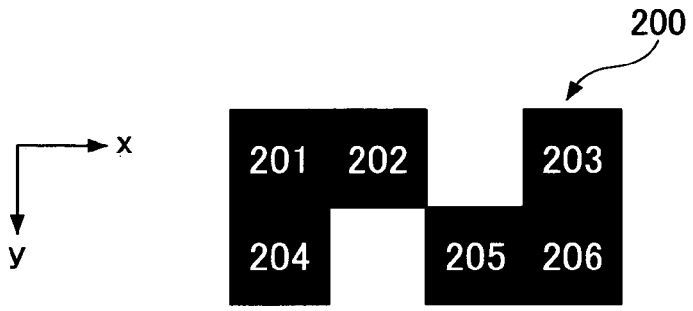
FIGS. 9A and 9B are drawings illustrating a drawing order in which drawing is carried out using drawing control method of the embodiment 1.
Figure 9B:
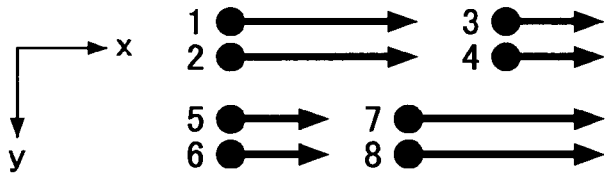

FIGS. 9A and 9B are drawings illustrating a drawing order in which drawing is carried out using a drawing control method of the embodiment 1; In FIGS. 9A and 9B, x and y axes are taken as shown. The x and y axes form an x, y coordinate system which represents a coordinate value (x, y) at which what is to be drawn is arranged.

A two-dimensional code shown in FIG. 9A is the same as a two-dimensional code shown in FIG. 1A. The two-dimensional code 200 includes six two-dimensional code components 201 to 206 from the upper left to the lower right. Each of the two-dimensional code components 201 and 206 is drawn in two lines. Moreover, an explanation is provided herein such that the size of the two-dimensional code component is equal to a size of a cell which is a unit area for drawing on a surface of the rewritable medium 50.

With the drawing control method of the embodiment 1, as shown in FIG. 9B, a laser is irradiated in the drawing order of 1 and then 2 to draw the upper-left two-dimensional code components 201 and 202. Next, the laser is irradiated in the drawing order of 3 and then 4 to draw the two-dimensional code component 203. Then, the laser is irradiated in the drawing order of 5 and then 6 to draw the two-dimensional code component 204. Finally, the laser is irradiated in the drawing order of 7 and then 8 to draw the two-dimensional code components 205 and 206. Such a determination of the drawing order is implemented by a drawing order determining process as shown in FIG. 10.

Figure 10:
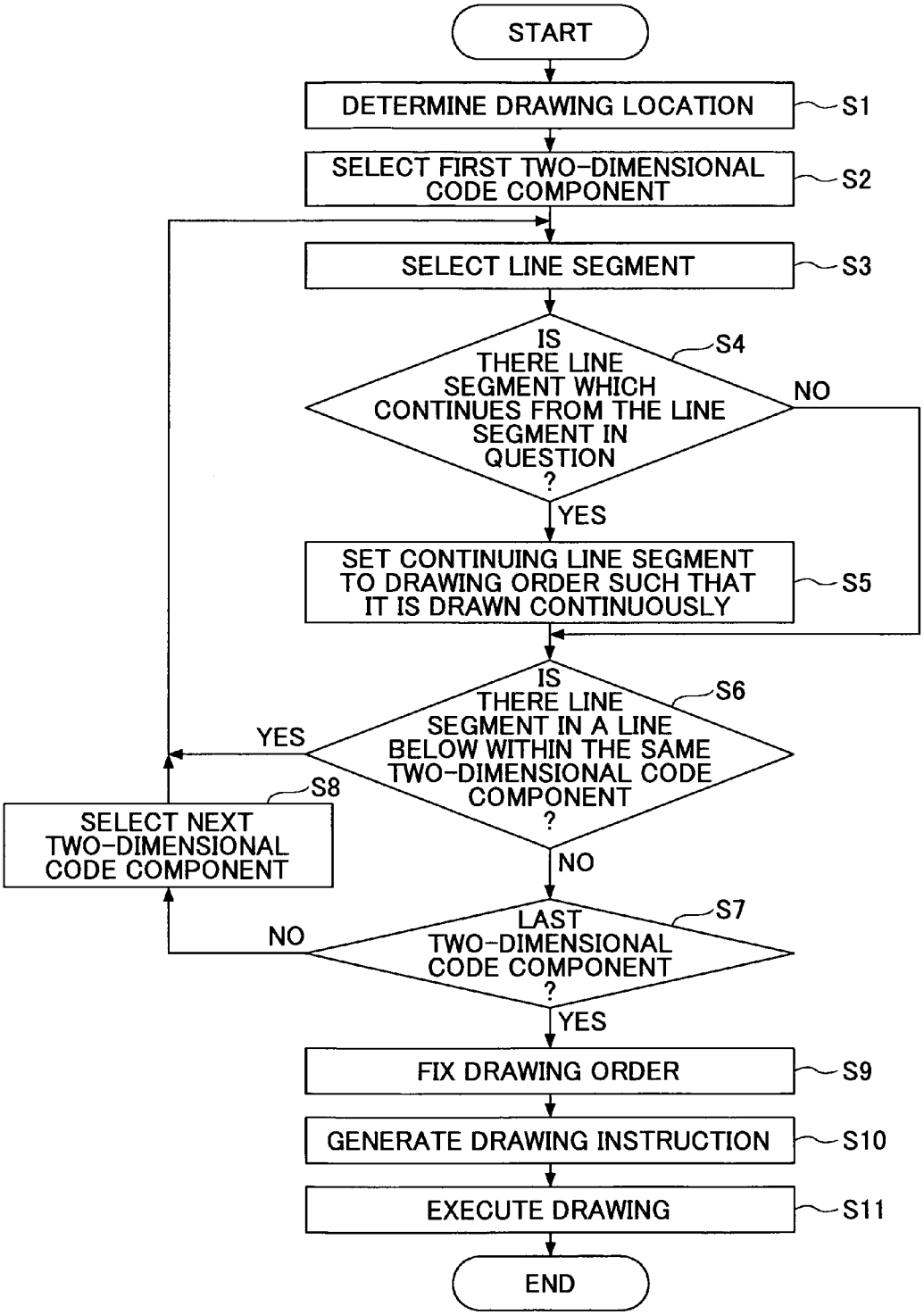
FIG. 10 is a flowchart illustrating a process of determining a drawing order by a drawing control method of the embodiment 1.

FIG. 10 is a flowchart illustrating a drawing order determining process by a drawing control method of the embodiment 1.

First, the drawing location determining unit 21 determines coordinate data, which is a drawing location for drawing, onto the rewritable medium 50, what is to be drawn, based on all two-dimensional code components included in a two-dimensional code read from the two-dimensional code DB 41 by the two-dimensional code obtaining unit 24 and a drawing condition read from the drawing condition DB 43 by the drawing condition obtaining unit 25 (step S1). In this way, coordinates at which all two-dimensional code components 201-206 are drawn by laser irradiation are determined.

Next, the drawing order determining unit 22 selects as a first two-dimensional code component, an upper-left two-dimensional code component out of all two-dimensional code components (step S2). In this way, the two-dimensional code component 201 is selected in an example shown in FIG. 9A.

Then, the drawing order determining unit 22 selects an upper-left line segment out of line segments included in the two-dimensional code component selected in step S2 (step S3).

Next, the drawing order determining unit 22 determines whether there is, in a line direction (a horizontal direction: an x axis direction), a line segment which continues from the line segment selected in step S3 (step S4). The process in step S4 determines the presence in the line direction (x-axis direction) of all line segments which continue from the line segment selected in step S3.

If it is determined that there is a continuing line segment in step S4, the drawing order determining unit 22 sets a drawing order of all continuing line segments for which the presence was determined in S4 to a drawing order such that it continues from the line segment selected in step S3 (step S5).

Then, the drawing order determining unit 22 determines whether there is a line segment in one line below in the same two-dimensional code component (step S6). In this way, in the example shown in FIG. 9A, line segments on a first line of the two-dimensional code component 202, which neighbors the two-dimensional code component 201, are selected.

If it is determined in step S6 that there is a line segment on one line below, the drawing order determining unit 22 returns the flow to step S3, and selects a leftmost line segment on the line. Then, the process from step S3 to step S6 is repeatedly executed, so that a drawing order for a two-dimensional code component selected first in step S2 is determined. In this way, in the example shown in FIG. 9A, line segments on a second line of the two-dimensional code components 201 and 202 are selected and drawing orders 1 and 2 shown in FIG. 9B are determined.

If it is determined in step 6 that there is no line segment on one line below, the flow proceeds to step S7, and the drawing order determining unit 22 determines whether it is a last two-dimensional code component (step S7).

If it is determined in step S7 that it is not the last two-dimensional code component, the drawing order determining unit 22 selects the next two-dimensional code component (step S8), and the flow returns to step S3. In step S8, all two-dimensional code components are successively selected from the upper left to the lower right. In this way, in the example shown in FIG. 9A, the two-dimensional code component 203, which is located further to the right of the two-dimensional code component 202 is selected. Following the two-dimensional code component 203, the two-dimensional code components 204, 205, and 206 are successively selected in that order.

If it is determined in step S7 that it is the last two-dimensional code component, the drawing order determining unit 22 fixes the drawing orders determined thus far (step S9). In this way, the drawing orders for all of the line segments included in the two-dimensional code components are determined.

Then, the drawing instruction generating unit 23 generates a drawing instruction which reflects coordinate data determined by the drawing location determining unit 21 and a drawing order determined by the drawing order determining unit 22. In this way, in the example shown in FIG. 9A, drawing orders 1-8 shown in FIG. 9B are determined for the two-dimensional code components 201-206.

Then, drawing is executed based on a drawing instruction (step S11). In this way, a two-dimensional code component 200 shown in FIG. 9A is drawn by laser irradiation.

Figure 1B:
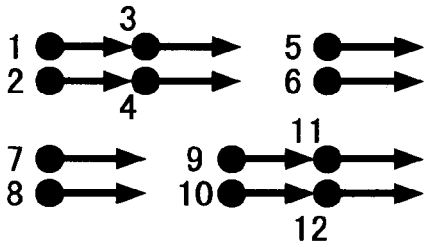

As described above, according to the drawing order determined by a drawing control method of the embodiment 1, a time for moving from an ending point of a line segment 1 to a starting point of a line segment 2, a time for moving from an ending point of the line segment 2 to a starting point of a line segment 3, and a time for moving from an ending point of the line segment 3 to a starting point of line segment 4 that are shown in FIG. 1B are reduced.

In this way, according to a drawing control method of the embodiment 1, a drawing order is determined such that drawing is carried out for each of a continuation of two-dimensional code components, making it possible to reduce the time for drawing all of the two-dimensional code.

While a form of drawing a two-dimensional code is described for the embodiment 1 in the foregoing, the drawing control method of the embodiment 1 may be applied to drawing what is to be drawn onto a medium that includes something other than a two-dimensional code, including a letter, a number, a symbol, a graphic, etc.

Embodiment 2

A drawing control method of an embodiment 2 is such that a starting point of a line segment is moved backward by a predetermined distance in a drawing direction in a drawing location determining step executed by the drawing location determining unit 21.

The hardware configuration, block configuration, and data structure shown in FIGS. 5-8B are the same as those for the drawing control device which executes the drawing control method of the embodiment 1, so that the explanation thereof is omitted and will be incorporated into the following explanation.

Figure 11:
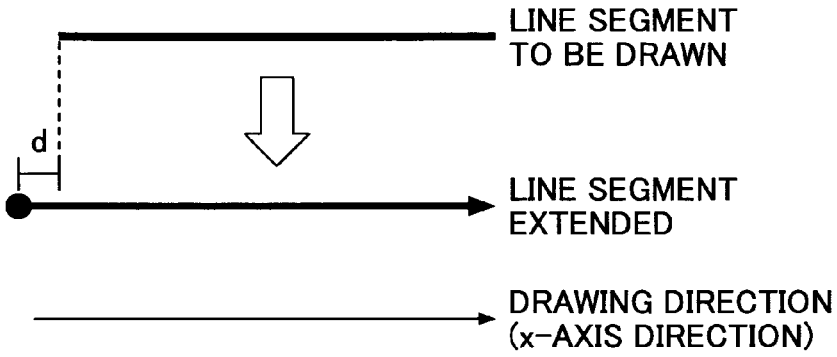
FIG. 11 is a conceptual diagram for explaining that a starting point of a line segment is moved backward in a drawing direction according to a drawing control method of an embodiment 2.

FIG. 11 is a conceptual diagram for explaining that a starting point of a line segment is moved backward in a drawing direction (an x-axis direction) according to a drawing control method of the embodiment 2.

Figure 12:
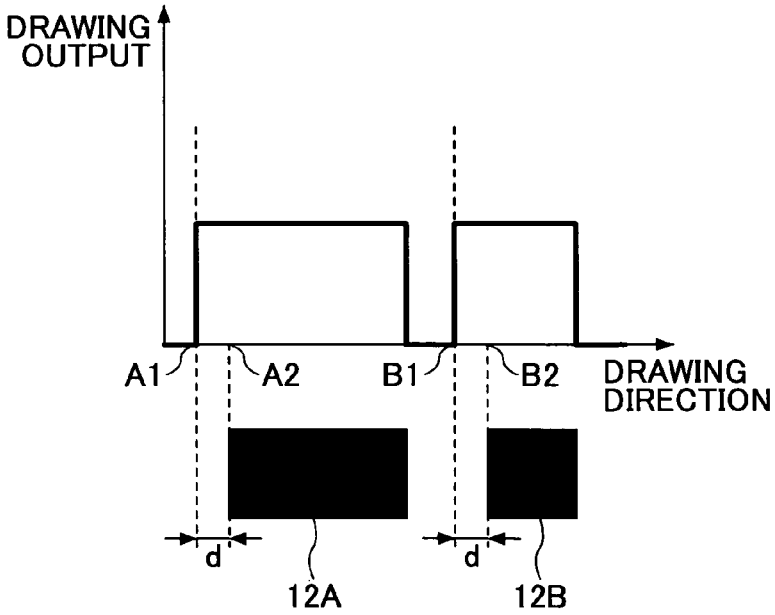
FIG. 12 is a diagram illustrating a process of, when drawing two line segments discontinuously, moving the respective line segment starting points backward in the drawing direction according to the drawing control method of the embodiment 2.

FIG. 12 is a diagram illustrating a process of, when drawing two line segments discontinuously, moving the respective line segment starting points backward in the drawing direction according to the drawing control method of the embodiment 2.

When the drawing location determining unit 21 determines coordinate data based on data representing a type of a two-dimensional code or a two-dimensional code component read from the two-dimensional code DB 41 by the two-dimensional code obtaining unit 24 and a drawing condition read from the drawing condition DB 43 by the drawing condition obtaining unit 25, a drawing starting location of the line segment that is to be a starting point is moved back by a distance d. In other words, with this process, a line segment which includes the starting point ends up being extended by a distance d in a backward movement direction in the drawing direction (in an x-axis direction), so that a laser is to be irradiated from a drawing starting point which is moved backward by the distance d.

Here, the starting point represents a drawing starting point, upstream in the drawing direction of which there is nothing to be drawn and from which drawing is started on the same line, while the drawing direction represents a horizontal direction shown.

Moreover, when two line segments 12A and 12B are discontinuously drawn according to the drawing control method of the embodiment 2, as shown in FIG. 12, respective line segment starting points may be moved backward by the distance d in the drawing direction. As a result, the locations from which laser irradiation is started become points A1 and B1, which are points moved backward in the drawing direction by the distance d relative to points A2 and B2, which are points at which color development of line segments to be drawn 12A and 12B is started.

Figure 13:
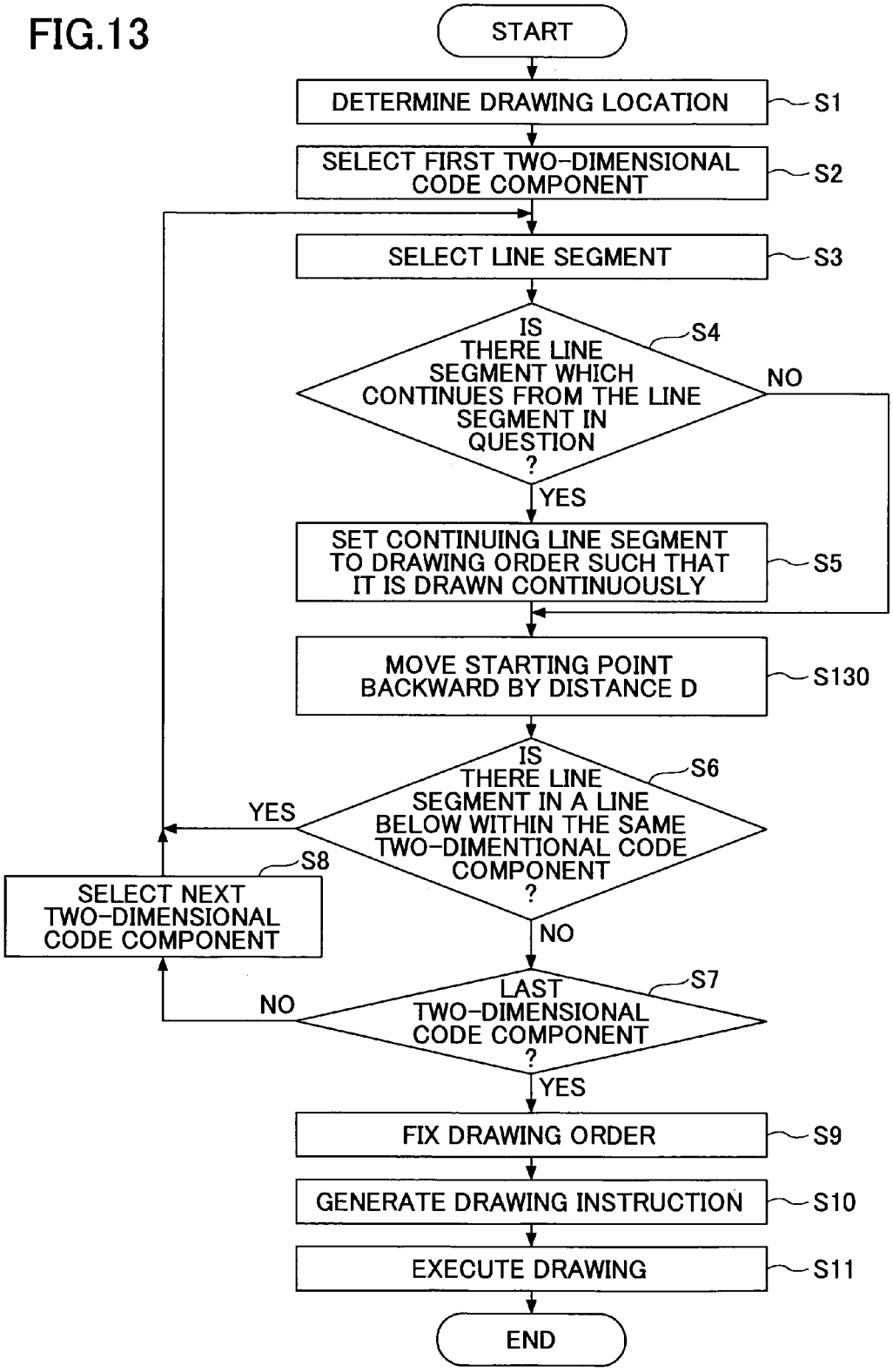
FIG. 13 is a flowchart illustrating a drawing order determining process according to a drawing control method of the embodiment 2.

FIG. 13 is a flowchart illustrating a drawing order determining process according to a drawing control method of the embodiment 2.

The drawing order determining process according to the drawing control method of the embodiment 2 that is shown in FIG. 13 is a process such that a step S130 is inserted between steps S5 and S6 of the drawing order determining process according to the drawing control method of the embodiment 1 (see FIG. 10). The whole process in steps S1-S11 shown in FIG. 13 is the same as steps S1-S11 shown in FIG. 10, so that the explanation thereof will be omitted.

In FIG. 13, if it is determined in step S4 by the drawing order determining unit 22 that there is no continuing line segment, or in step S5 a drawing order is set by the drawing order determining unit 22, the process in step S130 is carried out.

In step S130, the drawing location determining unit 21 moves backward, by a predetermined distance d, a line segment drawing starting location to be a starting point (step S130). In this way, a line segment which includes the starting point ends up being extended by a distance d in a backward movement direction in a drawing direction, so that a laser is to be irradiated from a drawing starting location which is moved backward by the distance d.

For the predetermined distance d with respect to the line segment drawing starting location to be the starting point, an experimental value may be determined in advance according to a drawing condition such as a width of a line segment to be drawn, a laser output, thermal characteristic of a medium (a rewritable medium 50, non-rewritable thermal paper, a non-rewritable medium such as plastic, metal, etc.), a temperature of a medium at the time of drawing, etc., and set to be an optimal value according to the drawing condition.

When the process in step S130 is completed, the drawing order determining unit 22 determines whether there is a line segment in a line which is one line below in the same two-dimensional code component (step S6).

Below, the process from step S6 and below is executed in the same manner as the drawing order determining process according to a drawing control method in the embodiment 1.

Figure 2A:
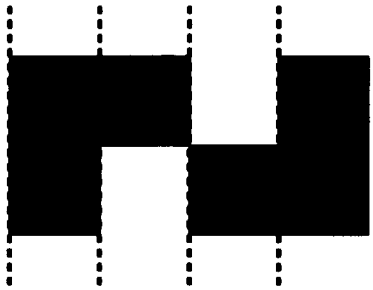
FIGS. 2A through 2C are views for explaining problems with related-art drawing methods.
Figure 2B:
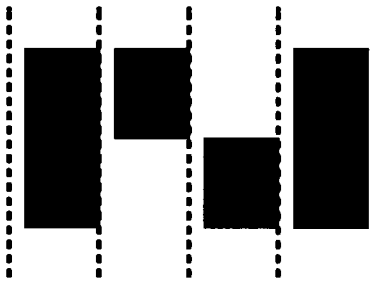
Figure 2C:
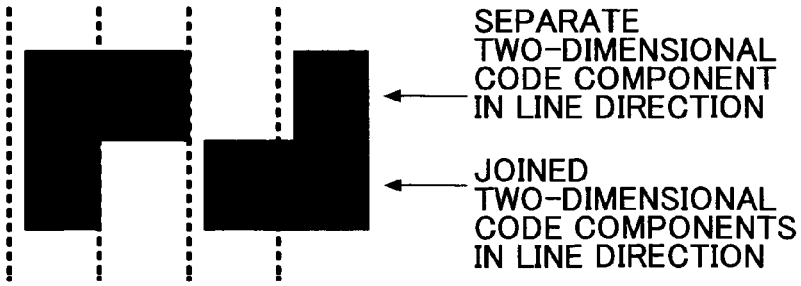
Figure 3A:
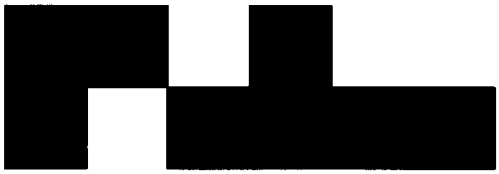
FIGS. 3A and 3B are views for explaining problems with related-art drawing methods.
Figure 3B:
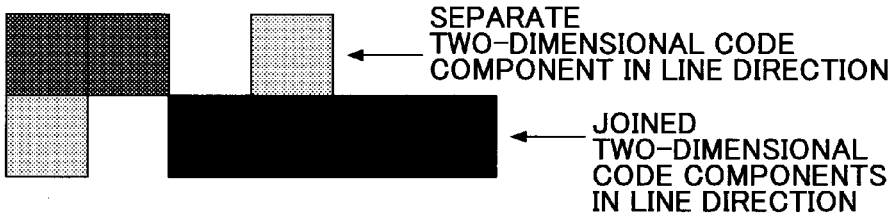
Figure 4:
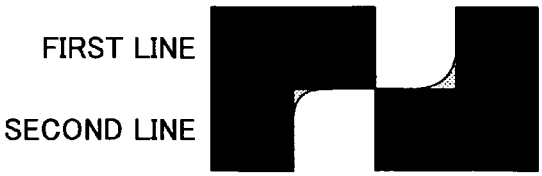
FIG. 4 is a view for explaining problems with a related-art drawing method.

As described above, according to the drawing control method of the embodiment 2, the coordinate of the starting point is moved backward by a distance d in the drawing direction, so that the starting point portion of what is to be drawn does not become short. Thus, as shown in FIGS. 2B and 2C, the problem caused by the difficulty with which the starting point develops color is solved, making it possible to draw a two-dimensional code with a decreased variation in the size of the two-dimensional code component due to the difference between the separate two-dimensional code component and joined two-dimensional code components and a gap between the two-dimensional code components. In other words, an accurate and high quality drawing may be executed efficiently.

While a form of drawing a two-dimensional code is described for the embodiment 2 in the foregoing, the drawing control method of the embodiment 2 may be applied to drawing what is to be drawn onto a medium that includes something, other than a two-dimensional code, such as a letter, a number, a symbol, a graphic, etc.

Embodiment 3

The drawing control method of an embodiment 3 is to set, in a pulse shape, a drawing output (laser output) for each of multiple drawing intervals to which one or multiple continuing line segments are divided.

Figure 14:
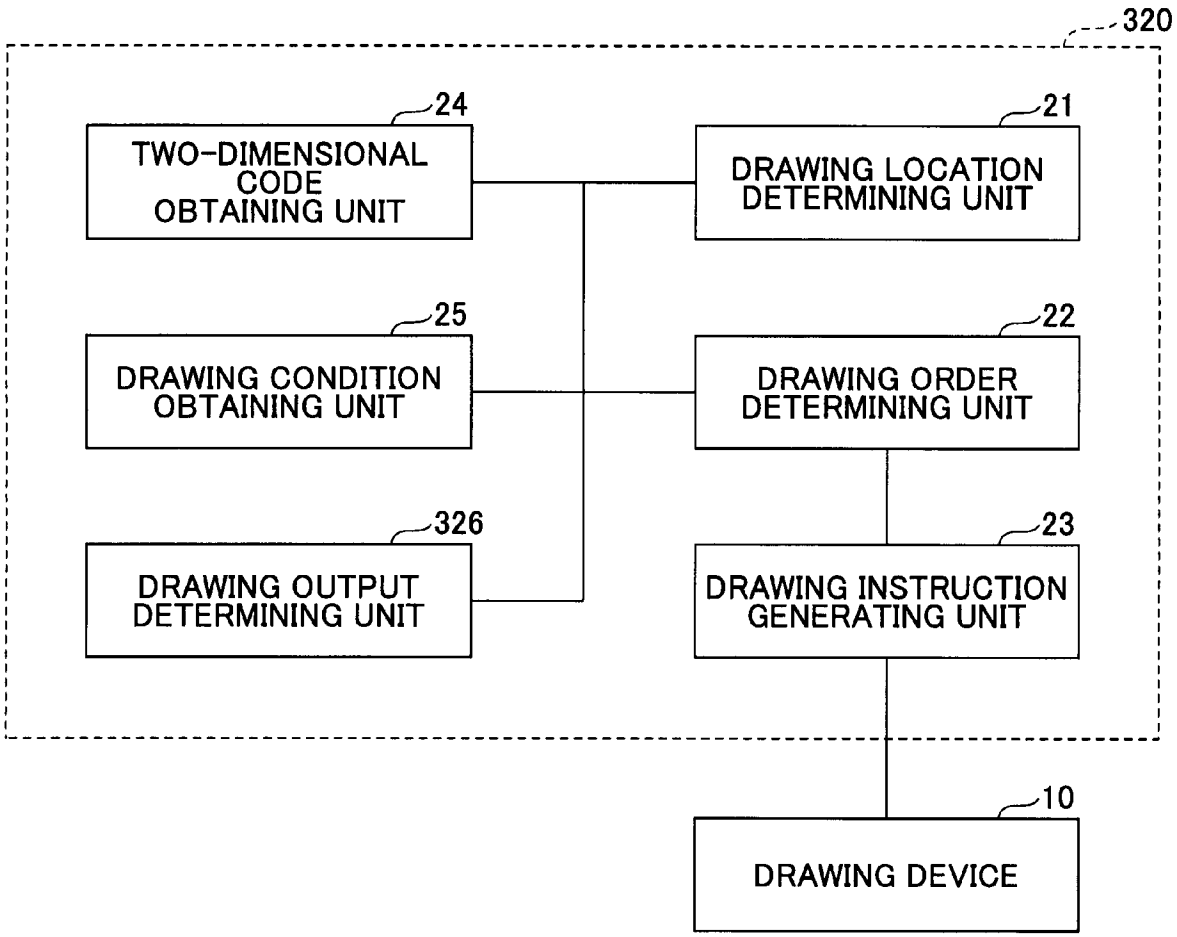
FIG. 14 is a drawing illustrating functional blocks of a drawing control device 320 of an embodiment 3.

FIG. 14 is a drawing illustrating functional blocks of a drawing control device 320 of the embodiment 3. Each block, when implemented in software, is implemented by a CPU 31 executing a drawing program 42.

The drawing control device 320 includes a drawing output determining unit 326 as well as a drawing location determining unit 21, a drawing order determining unit 22, a drawing instruction generating unit 23, a two-dimensional code obtaining unit 24, and a drawing condition obtaining unit 25. Of these, the drawing location determining unit 21, the drawing order determining unit 22, the drawing instruction generating unit 23, the two-dimensional code obtaining unit 24, and the drawing condition obtaining unit 25 are the same as those included in the drawing control device 20 in the embodiment, so that the explanation is omitted.

The drawing output determining unit 326 is to set, in a pulse shape, a drawing output (laser output) for each of multiple drawing intervals to which one or multiple continuing line segments are divided. The drawing output determining unit 326 generates a pulse-shaped laser output by turning on and off the laser oscillator 11. A galvanometer mirror scanning method is the same as the embodiment 1 in which a laser output is not pulse-shaped, so that there is no change due to making the laser output pulse shaped.

Figure 15:
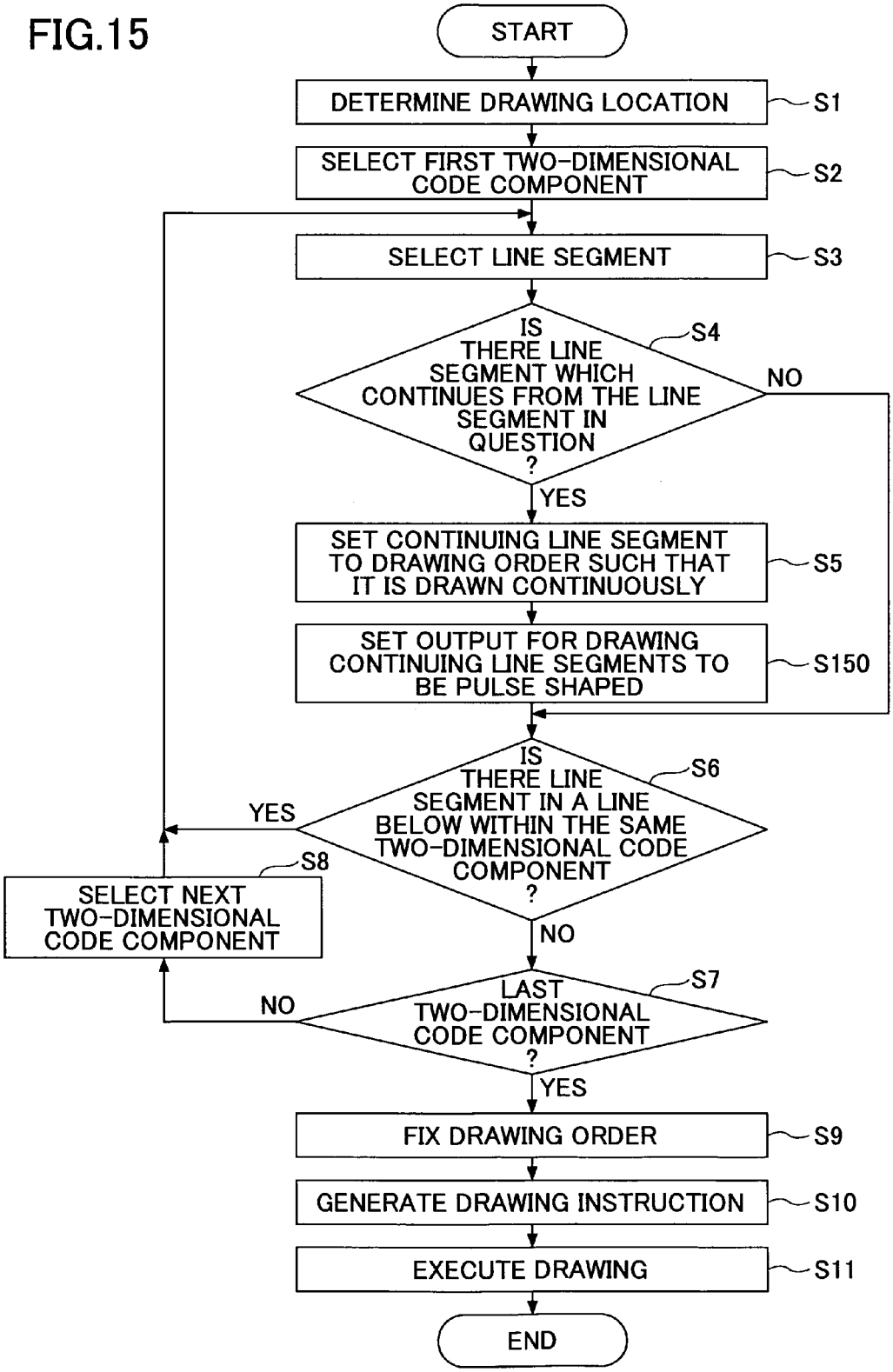
FIG. 15 is a flowchart illustrating a process of determining a drawing order by a drawing control method of the embodiment 3.

FIG. 15 is a flowchart illustrating a drawing order determining process according to a drawing control method of the embodiment 3.

The drawing order determining process according to the drawing control method of the embodiment 3 that is shown in FIG. 15 is a process such that a step S150 is inserted between steps S5 and S6 of the drawing order determining process according to the drawing control method of the embodiment 1 (see FIG. 10). The whole process insteps S1-S11 shown in FIG. 15 is the same as the process in steps S1-S11 shown in FIG. 10, so that the explanation thereof will be omitted.

In FIG. 15, if it is determined, in step S4, by the drawing order determining unit 22 that there is a continuing line segment, and, in step S5 thereafter, a drawing order is set by the drawing order determining unit 22, the process in step S150 is carried out.

In step S150, the drawing output determining unit 326 sets a drawing output such that a drawing output for drawing a continuing line segment becomes pulse-shaped when a continuing line segment is drawn (step S150).

More specifically, when drawing the continuing line segments, the drawing output determining unit 326 sets a drawing output for drawing the continuing line segments to be a pulse shape by making an interval exist such that the laser output becomes zero in between continuing line segments (a joint of the line segments).

In other words, each of continuing line segments is drawn in one pulse (for a line segment as a unit) and an interval is set such that a laser output becomes zero in between the line segments (at a joint of the line segments). In this way, for a separate line segment which does not continue to another line segment and each of continuing multiple line segments, a laser is continuously output for each line segment to carry out the drawing.

For a length of an interval within which a laser output becomes zero, an experimental value may be predetermined according to a drawing condition such as a width of a line segment to be drawn, a laser output, thermal characteristic of a medium (a rewritable medium 50, non-rewritable thermal paper, a non-rewritable medium such as plastic, metal, etc.), a temperature of a medium at the time of drawing, etc., and set to be an optimal value according to the drawing condition.

When the process in step S150 is completed, the drawing order determining unit 22 determines whether there is a line segment in one line below in the same two-dimensional code component (step S6).

Below, the process from step S6 and below is executed in the same manner as the drawing, order determining process according to a drawing control method in the embodiment 1.

FIGS. 16A through 16D are drawings illustrating a drawing order in which drawing is carried out according to the drawing control method of the embodiment 3.

Figure 16A:
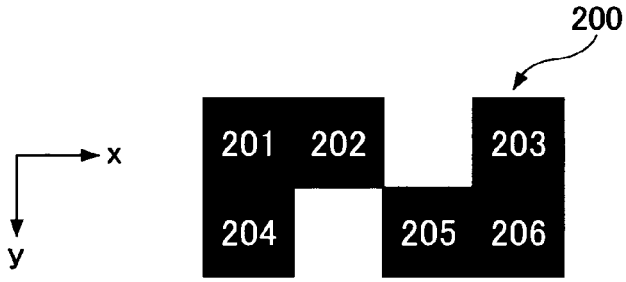
FIG. 16A through 16D are drawings illustrating a drawing order in which drawing is carried out using the drawing control method of the embodiment 3.

A two-dimensional code shown in FIG. 16A is the same as a two-dimensional code shown in FIG. 1A. The two-dimensional code 200 includes six two-dimensional code components 201 to 206 from the upper left to the lower right. Each of the two-dimensional code components 201 and 206 is drawn in two lines.

Figure 1C:
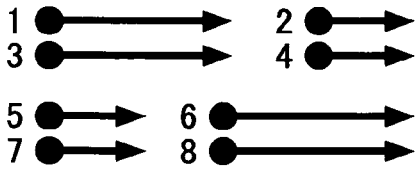
Figure 16B:
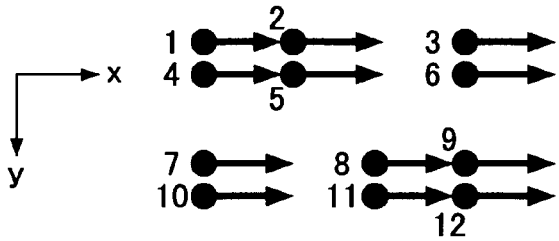

In the drawing control method of the embodiment 3, as shown in FIG. 16B, a case is shown such that the whole drawing order is the same as the raster scan in FIG. 1C. However, a continuing line segment is divided, and drawing output is made to be pulse shaped for each resulting drawing interval. The drawing control method of the embodiment 3 may be a method such that one or multiple continuing line segments are divided into multiple drawing intervals, so that a drawing output (laser output) is set in a pulse shape for each drawing interval; thus, as shown in FIG. 16B, it is not limited to an order such as a raster scan.

Figure 16C:
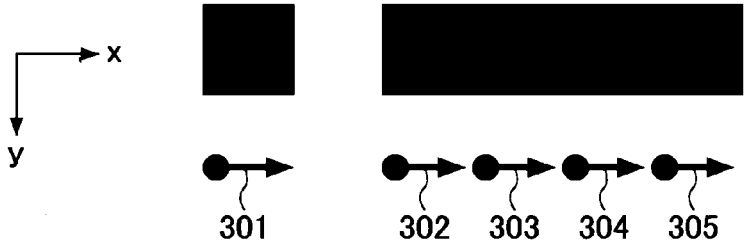
Figure 16D:
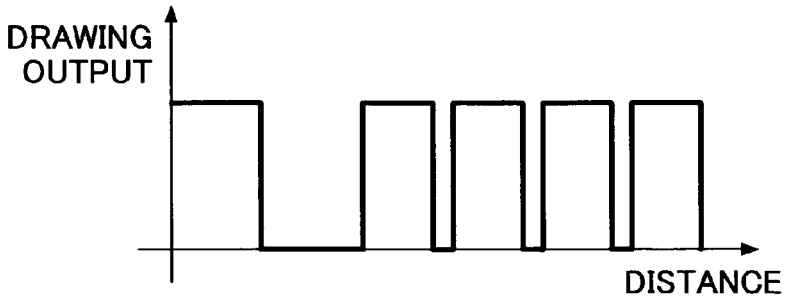

For example, as shown in FIG. 16C, when drawing four continuing line segments 302-305 subsequent to drawing one line segment separated by a blank therebetween, a drawing instruction is generated which provides a pulse-shaped drawing output to a drawing device 10 as shown in FIG. 16C when drawing each of the continuing line segments 302-305. The drawing instruction for implementing a pulse-shaped drawing output is not limited to a technique of determining such that the drawing output determining unit 326 outputs the pulse-shaped drawing output when drawing the continuing line segments, so that, it may be arranged, without having provided the drawing output determining unit 326, to obtain a pulse-shaped drawing output by, in coordinate data, dividing continuing line segments and shortening them by a predetermined length such that line segments do not connect.

In this way, heat storage of a long joined two-dimensional code components may be reduced, making it possible to draw both a short line segment and a joined line segment at a uniform density.

In an example shown in FIG. 16A, while a border between ON and OFF of a pulse is arranged such that it corresponds to a size of a cell, a pulse width and a pulse interval are not so limited thereto and may be determined arbitrarily.

Moreover, one line segment such as a line segment 301 shown in FIG. 16C may be divided into multiple intervals.

In the above-described embodiment 3, a laser oscillator 11 is turned on/off in order to make a laser output (drawing output) pulse shaped, so that it is not required that a galvanometer mirror be operated in order to generate a pulse-shaped laser output. Therefore, a pulse-shaped laser output may be generated with only on/off control of the laser oscillator 11 and a laser output may be turned on/off at high speed, so that it may be applicable for drawing at high speed.

Moreover, in this way, making a drawing output pulse shaped may be incorporated into a drawing control method of the embodiment 1 or 2, or may be incorporated into a drawing control method of the below-described embodiment 4.

Furthermore, while a form of drawing a two-dimensional code is described for the embodiment 3 in the foregoing, the drawing control method of the embodiment 3 may be applied to drawing what is to be drawn onto a medium that includes something other than a two-dimensional code, such as a letter, a number, a symbol, a graphic, etc.

Embodiment 4

Figure 17:
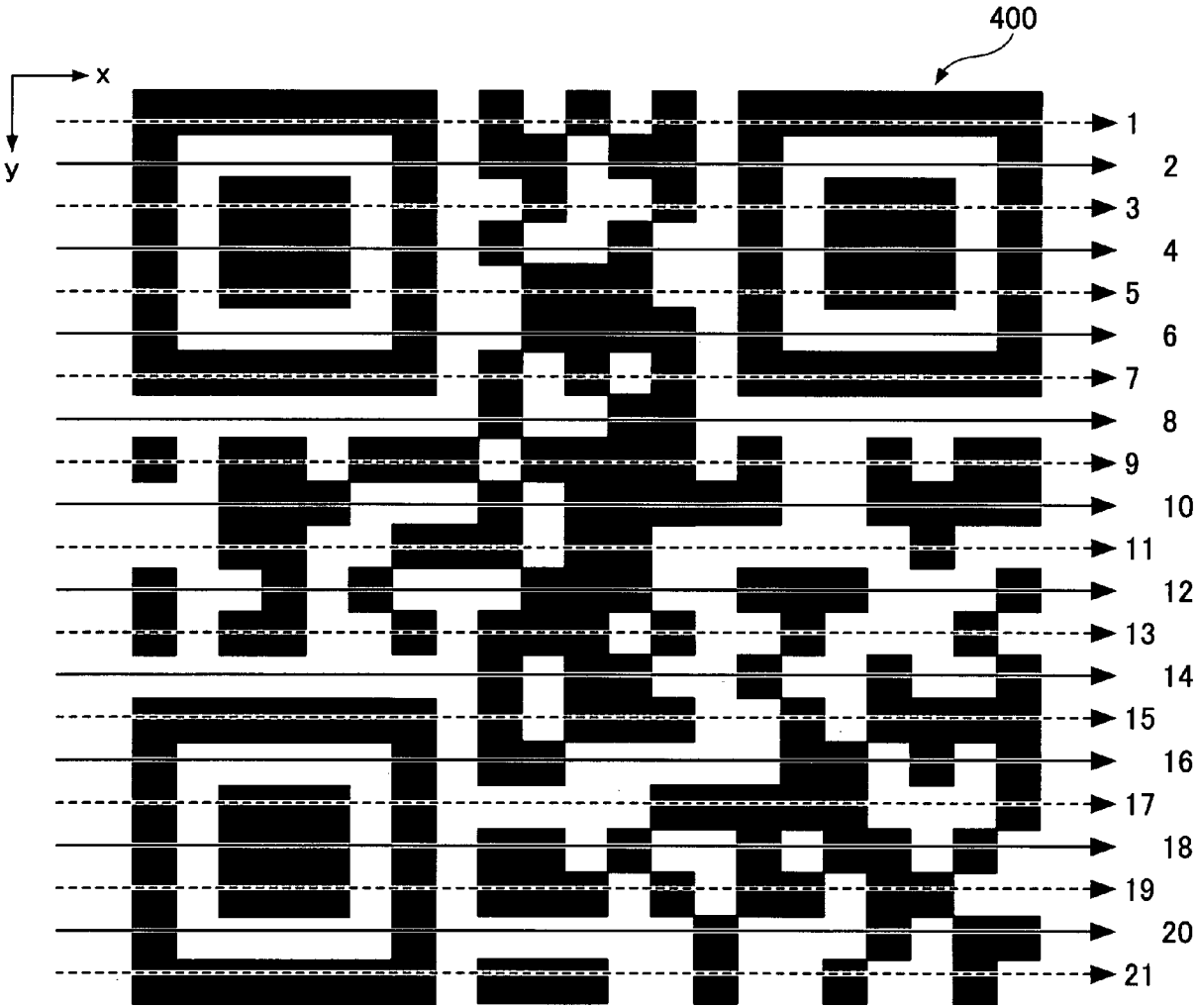
FIG. 17 is a conceptual diagram illustrating a drawing order by a drawing control method of an embodiment 4.

FIG. 17 is a conceptual diagram illustrating a drawing order according to a drawing control method of an embodiment 4.

According to the drawing control method of the embodiment 4, in the drawing order determining step executed in the drawing order determining unit 22, a drawing order of all line segments included in a two-dimensional code 400 is determined such that, when determining the drawing order of the two-dimensional code 400 is completed by drawing multiple lines, out of line segments on the multiple lines, odd-numbered lines are successively drawn line by line and then even-numbered lines are successively drawn line by line, or the even-numbered lines are successively drawn line by line and then the odd-numbered lines are successively drawn line by line.

Thus, the hardware configuration, the block configuration, and the data structure are the same as for the drawing control device which executes the drawing control method of the embodiment 1 shown in FIGS. 5-8, so that the explanation thereof is omitted, and is incorporated in the description below.

In other words, as shown in FIG. 17, line segments included in odd-numbered lines (a first line to a $21^{st}$ line) are drawn from left to right from a top line to a bottom line in an interlaced manner, such that when the bottommost 21st line is completed, the process returns to the top and line segments included in the even-numbered lines (from a second line to a twentieth line) are drawn from left to right in an interfaced manner.

When a length of a line of a two-dimensional code is small, or a printing speed is high, and when a following line is to be drawn, there is a problem that an impact of heat of a previous line remains when the next line is drawn, causing a portion which should not develop color to develop color and causing printing quality to be poor.

However, in a drawing order shown in FIG. 17, when an odd-numbered line and an even-numbered line are successively drawn in an interlaced manner, an impact of heat is suppressed at the time of drawing a neighboring odd-numbered line on an even-numbered line and, similarly, an impact of heat is suppressed at the time of drawing a neighboring even-numbered line on an odd-numbered line.

In this way, it is possible to prevent a portion which should not develop color from developing color due to heat of the previous line.

The same advantageous effect is obtained regardless of whether there is one line or there are multiple lines included in a two-dimensional code component corresponding to a size of one cell, for example.

Figure 18A:
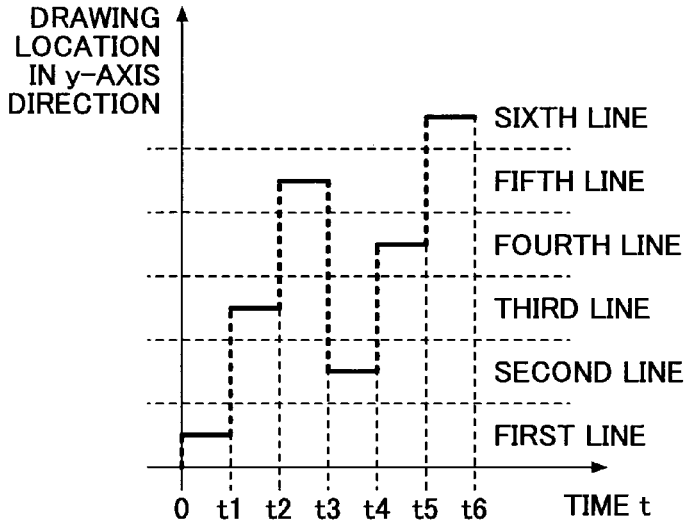
FIGS. 18A and 18B are diagrams illustrating a process of drawing according to a drawing control method of the embodiment 4.
Figure 18B:
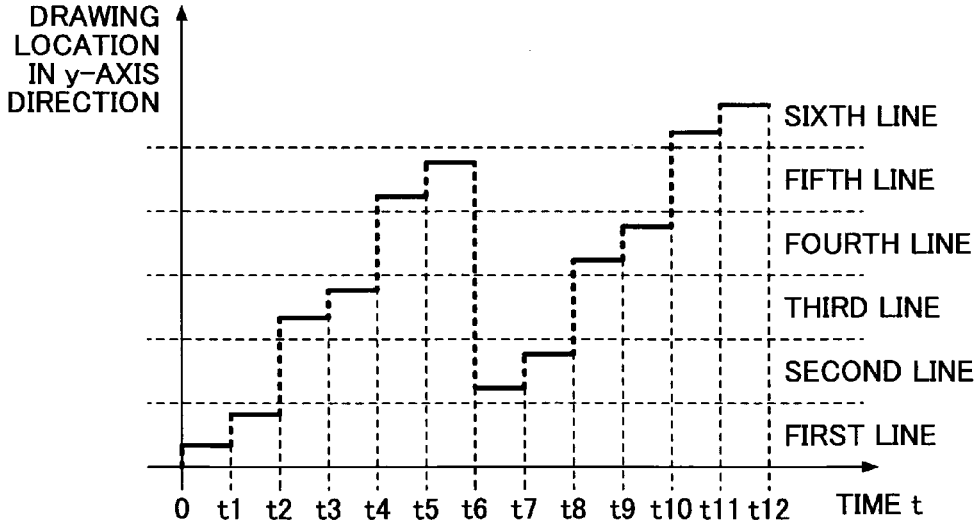

FIGS. 18A and 18B are diagrams illustrating a procedure of drawing according to the drawing control method of the embodiment 4.

In FIGS. 18A and 18B, the horizontal axis represents time, while the vertical axis represents a drawing location in the y axis direction. FIGS. 18A and 18B show a procedure for drawing a six-line two-dimensional code in the y-axis direction. FIGS. 18A and 18B show a drawing location in the Y axis direction on a vertical axis with an upper direction as main, but the actually drawn two-dimensional code is drawn from the top to the bottom in a manner similar to 21-line two-dimensional code shown in FIG. 17.

Moreover, FIG. 18A shows a drawing procedure when a two-dimensional code component is drawn in one line segment, and FIG. 18B shows a drawing procedure when a two-dimensional code component is drawn in two line segments (see FIGS. 9A and 9B).

In FIGS. 18A and 18B, an interval shown in a broken line shows an interval for moving to a starting point of a line segment to draw next without carrying out the drawing. An interval shown in a solid line represents an interval for drawing a line segment.

In the actual drawing, a waiting time is provided for waiting for a galvanometer mirror to stabilize between the starting point and the ending point of the moving interval, but the waiting time is minute compared to a time required for a drawing interval or a moving interval, so that it is omitted in FIGS. 18A and 18B. Moreover, described below is a procedure illustrated in FIGS. 18A and 18B as what is to be executed by a drawing control device 20 of the embodiment 4 (that incorporates FIG. 7).

In FIG. 18A, the drawing control device 20 starts drawing at time t=0 and draws a line segment on a first line from t=0 to t=t1. Then, the process moves to a third line, drawing the third line at time t1 to t2. Next, the process moves to a fifth line, drawing the fifth line at time t2 to t3.

When the drawing of the line segment on the fifth line is completed, the drawing control device 20 moves to a second line to carry out drawing on an even-numbered line, drawing a line segment on the second line at time t3 to t4. Next, the process moves to a fourth line, drawing the fourth line at time t4 to t5. Next, the process moves to a sixth line, drawing the sixth line at time t5 to t6.

According to the above, the drawing process by the drawing control device 20 is completed, making it possible to carry out drawing with odd-numbered and even-numbered lines being divided in a manner similar to the two-dimensional code 40 as shown in FIG. 17.

Next, a drawing procedure is explained which is shown in FIG. 18B.

In FIG. 18B, the drawing control device 20 starts drawing at time t=0, and draws a first line segment on a first line from t=0 to t1. Next, at time t1 to t2, a second line segment on the first line is drawn. Next, the process moves to a third line, drawing a first line segment on the third line at time t2 to t3 and drawing a second line segment on the third line at time t3 to t4. Next, the process moves to a fifth line, drawing a first line segment on the fifth line at time t4 to t5 and drawing a second line segment on the fifth line at time t5 to t6.

When the drawing of the line segment on the fifth line is completed, the drawing control device 20 moves to a second line to carry out drawing on an even-numbered line, drawing a first line segment on the second line at time t6 to t7, and drawing a second line segment on the second line at time t7 to t8. Next, the process moves to a fourth line, drawing a first line segment on the fourth line at time t8 to t9 and drawing a second line segment on the fourth line at time t9 to t10. Next, the process moves to a sixth line, drawing a first line segment on the sixth line at time t10 to t11 and drawing a second line segment on the sixth line at time t11 to t12.

According to the above, the drawing process by the drawing control device 20 is completed, making it possible to carry out drawing of two-dimensional code components, with even-numbered lines and odd-numbered lines divided, for what is to be drawn that is necessary to be drawn into two line segments.

The above-described drawing control method of the embodiment 4 makes it possible to suppress the thermal effect between neighboring odd-numbered and even-numbered lines, making it possible to efficiently execute an accurate and high-quality drawing.

The drawing control method of the interlaced scheme may also be combined with drawing control methods of the embodiments 1 to 3.

Furthermore, while a form of drawing a two-dimensional code is described for the embodiment 4 in the foregoing, the drawing control method of the embodiment 4 may be applied to drawing of what is to be drawn onto a medium that includes something other than a two-dimensional code, such as a letter, a number, a symbol, a graphic, etc.

In the foregoing, drawing control methods, laser irradiating apparatuses, drawing control programs and recording media having recorded them are described according to the exemplary embodiments of the present invention; however, the present invention is not limited to specifically disclosed embodiments, so that modifications and alterations are possible without departing from the claims.

The present application is based on and claims the benefit of priority of Japanese Patent Application Nos. 2009-240398 filed on Oct. 19, 2009 and 2010-202723 filed on Sep. 10, 2010, the entire contents of which are hereby incorporated herein by reference.

The invention claimed is:

1. A drawing control method which controls, by a computer, a drawing device to draw line segments on a surface of a medium in a single line segment direction by providing pulse signals to the drawing device, each line segment corresponding to the length of one of the pulse signals and defining the length of a unit region, wherein multiple unit regions are adjacently arranged in the line segment direction, the method comprising:

a drawing order determining step wherein the computer determines a drawing order of the line segments by determining, for each one of the line segments to be drawn in any one of said unit regions, whether another line segment to be drawn in an adjacent one of the unit regions forms a continuation in the line segment direction of said one of the line segments, and where it is determined that the another line segment to be drawn in an adjacent one of the unit regions forms a continuation in the line segment direction of said one of the line segments, determining that said one of the line segments and the another line segment are to be drawn sequentially with no intervening line segment being drawn between said one of the line segments and the another line segment, and if it is determined that there is no adjacent unit region to be drawn, determines a drawing order in which the following line segment within the same unit region is drawn; and a step of controlling the drawing device to draw the line segments onto the multiple unit regions on the surface of the medium according to the drawing order determined in the drawing order determining step, wherein a plurality of line segments that are mutually spaced in a direction transverse to the line segment direction are sequentially drawn onto each of the unit regions.

2. A laser irradiating apparatus which is controlled by the drawing control method claimed in claim 1, wherein the drawing device comprises:

a laser oscillator which irradiates a laser;

a direction control mirror which controls an irradiating direction of the laser which is irradiated by the laser oscillator; and a direction control motor which drives the direction control mirror in the line segment direction.

3. The drawing control method according to claim 1, further comprising:

a step of determining a starting point for drawing the one of said line segments from the starting point to an ending point of the line segment, wherein in said step of controlling the drawing device to draw the line segments onto the multiple unit regions on the surface of the medium according to the drawing order determined in the drawing order determining step, for at least the one of said line segments the starting point is moved backward by a predetermined distance, and the drawing device is controlled to draw the one of said line segments beginning at said predetermined backward distance.

4. The drawing control method according to claim 1, wherein the multiple unit regions comprise two-dimensional code components.

5. A drawing control method which controls, by a computer, a drawing device comprising a laser to apply energy to a medium to draw line segments on a surface of the medium, the method comprising:

a step of determining a line segment starting point for drawing one of said line segments from the line segment starting point to an ending point of the line segment;

step of determining a starting point of applying the energy to the medium at a point located backward by a predetermined distance from the line segment starting point; and a step of controlling the drawing device to draw the one of said line segments by starting applying the energy to the medium beginning at said point located backward by the predetermined backward distance.

6. The drawing control method according to claim 5, wherein said predetermined distance is a function of the width of said one of the line segments.

7. The drawing control method according to claim 5, wherein said predetermined distance is a function of an output value of the drawing device.

8. The drawing control method according to claim 5, wherein said predetermined distance is a function of a thermal characteristic of a medium onto which said one of the line segments is to be drawn.

9. The drawing control method according to claim 5, wherein said predetermined distance is a function of one of a temperature of the medium at the time of drawing.

10. A laser irradiating apparatus which is controlled by the drawing control method claimed in claim 5, wherein the drawing device comprises:

a laser oscillator which irradiates a laser;

a direction control mirror which controls an irradiating direction of the laser which is irradiated by the laser oscillator; and a direction control motor which drives the direction control mirror in the line segment direction.

11. The drawing control method according to claim 5, wherein the multiple unit regions comprise two-dimensional code components.

12. The drawing control method according to claim 11, wherein all of said line segments extend in a single line segment direction.

13. The drawing control method according to claim 5, wherein all of said line segments extend in a single line segment direction.

14. The drawing control method according to claim 5, wherein the step of moving the starting point backward by a predetermined distance moves the starting point away from the ending point.

* * * * *